United States Patent [19]

Bay

[11] 4,437,040

[45] Mar. 13, 1984

[54] METHOD OF EFFECTING STABILIZED DIMMING OF FLUORESCENT LAMPS

[75] Inventor: David L. Bay, Beverly, Mass.

[73] Assignee: GTE Products Corporation, Stamford, Conn.

[21] Appl. No.: 367,307

[22] Filed: Apr. 12, 1982

[51] Int. Cl.[3] ..... H05B 37/02

[52] U.S. Cl. ..... 315/209 R; 315/210; 315/282; 315/DIG. 4; 315/DIG. 2; 315/220

[58] Field of Search ..... 315/DIG. 4, 209 R, 210, 315/282, DIG. 2, 220

[56] References Cited

U.S. PATENT DOCUMENTS 2,830,232 4/1958 Carpenter et al. ..... 315/DIG. 4

4,353,009 10/1982 Knoll ..... 315/220

*Primary Examiner*—Harold Dixon

*Attorney, Agent, or Firm*—John A. Odozynski

[57] ABSTRACT

In order to effect stabilized dimming of a fluorescent lamp, that is, in order to vary the power level supplied the lamp while maintaining a substantially constant filament voltage, a first, variable, inductance is included as an element of oscillator (inverter) feedback loop. The voltage across the variable inductance is clamped and coupled to a second inductance so that a voltage appears across the second inductance in proportion to the voltage appearing across the variable inductance. The voltage appearing across the second inductance is applied to the lamp filament so as to constitute a dominant component of the lamp filament voltage.

5 Claims, 1 Drawing Figure

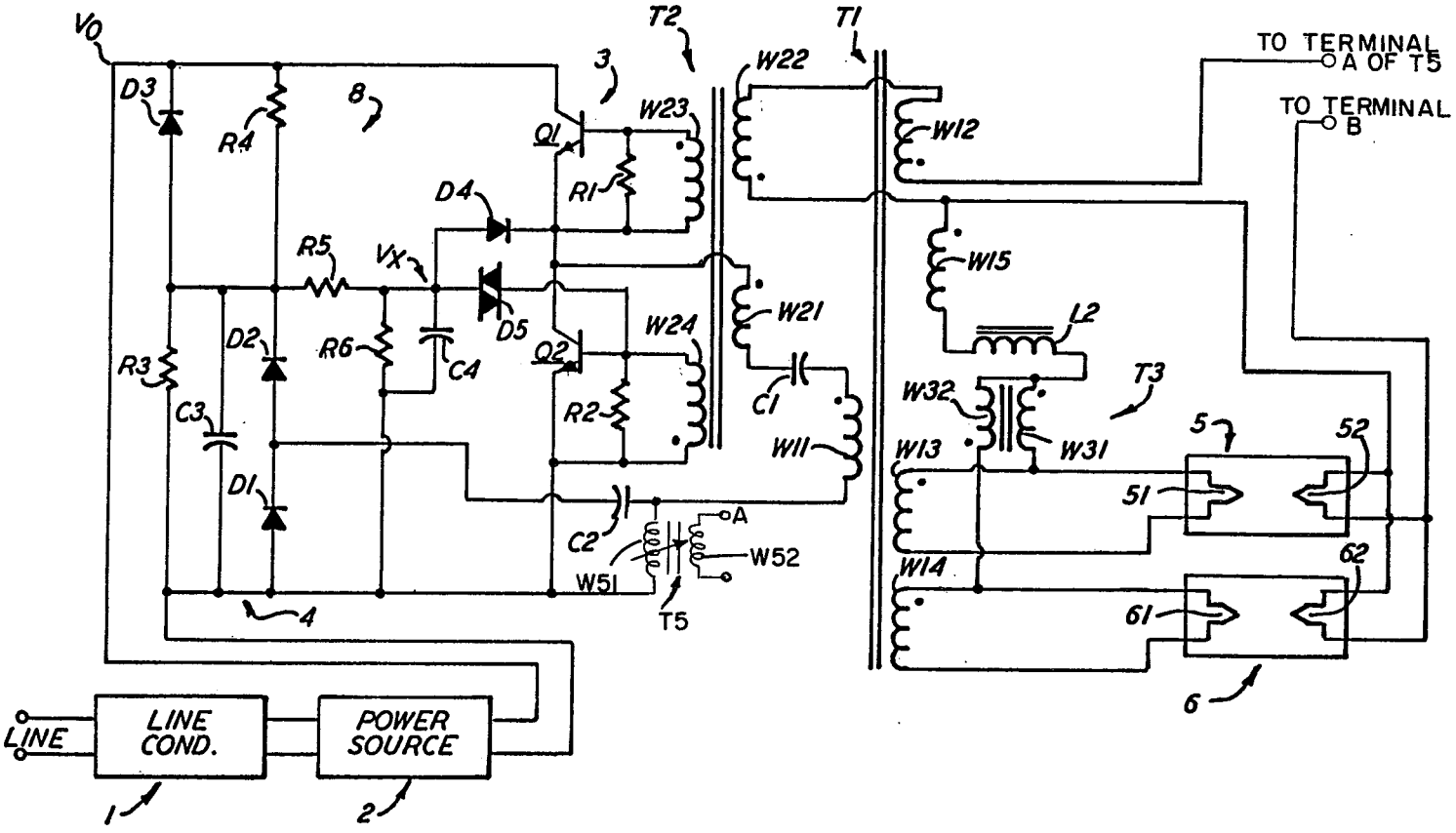
TO TERMINAL A OF T5
TO TERMINAL B
52
62
5
6
51
61
T3
L2
W31
W15
W12
W32
W13
W14
T1
W22
W21
C1
W11
W52
A
T5
T2
W23
W24
3
R1
R2
C2
W51
Q1
Q2
D5
D4
C4
Vx
8
R6
R5
R4
D2
D1
4
C3
D3
R3
V0
POWER SOURCE
2
LINE COND.
1
LINE

METHOD OF EFFECTING STABILIZED DIMMING OF FLUORESCENT LAMPS

TECHNICAL FIELD

This invention relates to electronic ballast systems and more particularly to a method of dimming fluorescent lamps that maintains a more nearly constant, or stable, filament voltage regardless the operating power level of a dimmable ballast.

BACKGROUND ART

U.S. Pat. No. 4,188,661, "Direct Drive Ballast With Starting Circuit" by Bruce L. Bower and Raymond H. Kohler, dated Feb. 12, 1980, assigned to the assignee of the present invention, and hereby incorporated by reference, describes an electronic ballast circuit for driving a pair of fluorescent lamps. Central to the operation of that circuit is a high frequency (20 to 30 KHz) inverter comprising two transistors connected in series and operating in a push-pull mode. The inverter drives, via an output transformer, the cathode filaments of the lamps. The output transformer comprises a series-resonant primary winding coupled to the inverter output. The secondary of the output transformer includes one lamp voltage winding and three filament windings. Two filament windings separately supply current to one filament of each of the lamps. The third filament winding supplies current to the remaining two, parallel-connected, filaments. Also, included on the secondary of the output transformer is a series connected discrete ballasting inductor in series with a pair of bias windings oppositely poled and connected in series between the first and second filament windings. These windings are arranged so as to establish a voltage differential across the respective lamps sufficient to effect firing of the lamps.

The ballast circuit further includes an interstage transformer having three primary-wound feedback windings each coupled in a loop that includes at least one lamp filament and a filament winding. The secondary of the interstage transformer includes a pair of oppositely-poled drive windings coupled to the push-pull inputs of the inverter. Because the primary windings are coupled in a loop that includes the lamp filaments, they induce a voltage in a secondary proportional to the sum of filament currents. Proper phasing of the secondary windings provides the positive feedback necessary to sustain inverter operation. (A modified feedback arrangement disclosing a single primary winding connected in a loop with the two parallel-connected filaments is disclosed in U.S. Pat. No. 4,127,893, "Tuned Oscillator Ballast Circuit With Transient Compensating Means" by Charles A. Goepel and assigned to the assignee of the present invention. See FIG. 2 of that patent.)

U. S. Pat. No. 4,188,661 also discloses circuitry for enhancing the oscillator startup operation. Upon initial energization of the ballast circuit, a capacitor connector in parallel with one of the secondaries of the interstage transformer is charged through a source of slowly developed DC voltage. When the charge across the capacitor reaches a given magnitude, a series connected diac is switched on thereby discharging the capacitor through a relatively low impedance and causing a transient across one of the drive windings of the interstage transformer. This perturbation supplies base drive to at least one of the inverter transistors and assures oscillator startup. A voltage derived from the current in the primary of the output transformer is applied to the diac in a manner that renders the diac nonconducting during steady state operation of the ballast circuit.

A related ballast circuit is disclosed in Ser. No. 218,311, cited above, and includes inter alia, an improved drive scheme for the transistorized inverter, a delayed starting circuit, a reconfigured output scheme and, in particular, a dimming circuit amenable to control from a remote location. (The dimming circuit disclosed in Ser. No. 218,311 may be deemed an alternative to, albeit in some respects an improvement upon, the dimming circuit disclosed in U.S. Patent application Ser. No. 55,667, "Electronic Ballast Dimming Circuitry", filed July 9, 1979, now abandoned, by Gerald T. Smith and assigned to the assignee of this invention.) Dimming is effected by varying an inductance, and hence the total impedance, in a feedback loop that includes the primary of the output transformer and the transistor inverter. The variable inductance assumes the form of a saturable reactor, the effective inductance of which is varied according to the amplitude of a signal (DC current or voltage) applied to an associated control winding. As the effective inductance, i.e., impedance, of the saturable reactor is decreased, the amount of feedback applied to the inverter is increased and the power supplied to the lamps increased accordingly.

While it cannot be gainsaid that the circuitry disclosed therein represents a substantial advance in the state of the art of electronic ballast design, especially in that it provides remote dimming capability via a technique compatible with standard integrated circuit or computer-type control modules of modest power sourcing capacity, it will become clear that the subject invention represents yet another distinct advance in that art.

DISCLOSURE OF THE INVENTION

The above and other objects and advantages are achieved in one aspect of this invention by a stabilized dimming circuit for an electronic ballast system that includes an output transformer having a primary winding and at least one secondary winding adapted for coupling to the filament of, for example, a fluorescent lamp. The dimming circuit comprises a dimming transformer characterized by a variable inductance primary winding coupled to the primary of the output transformer. The secondary winding of the dimming transformer is included in a circuit loop that is completed by a secondary winding of the output transformer and a lamp filament.

BRIEF DESCRIPTION OF THE DRAWINGS

The sole drawing is a schematic diagram of a novel electronic ballast circuit for implementing the subject invention.

DESCRIPTION OF THE PREFERRED EMBODIMENT

For a better understanding of the present invention, together with the objects, advantages and capabilities thereof, refer to the following disclosure and appended claims in conjunction with the accompanying drawing.

Referring now to the drawing, the electronic ballast circuit derives its primary power from the AC line through a line conditioner 1. The line conditioner may include, inter alia, a transient suppressor, overload switch and line filter. See, e.g. U.S. Pat. No. 4,188,661, supra, at column 2, lines 38–48, column 3, lines 36–52, and as illustrated in the drawing as element 5. The output of the line conditioner is coupled to the input of a voltage supply 2 which provides a nominal output voltage, $V_o$, of 300 volts.

The core of the electronic ballast system illustrated in the drawing is the high frequency, series push-pull inverter 3 comprising NPN transistors Q1 and Q2. Q1 has a collector connected to the high side of the voltage supply and an emitter connected to the collector of Q2; the emitter of Q2 is in turn connected to the common or ground return of the voltage supply. The base-to-emitter junctions of both Q1 and Q2 are individually coupled by damping resistors, R1 and R2, respectively. The output of inverter 3, that is, the signal at the junction of Q1 emitter and Q2 collector, is coupled through a capacitor C1 to one end of the primary winding, W11, of output transformer T1. A detailed discussion of the construction and operation of T1 is presented below. In a preferred embodiment the output of the inverter is coupled to W11 through a network that includes the series connection of C1 and a phase-feedback winding, W21, on the primary of an interstage transformer T2. The other end of W11 is coupled to the input of what, for present purposes, will be considered a secondary voltage source 4.

Voltage source 4 includes a variable inductance primary winding W51 on transformer T5, connected between W11 and the common return. The junction of W11 and W51 is coupled through capacitor C2 to a voltage-doubling peak rectifier that includes diodes D1 and D2, charge storage capacitor C3, and resistor R3. D2 has a cathode connected to C3 and an anode connected to the common part of the cathode of D1 and one side of C2; the other side of C2 is connected to the juncture of W51(T5) and W11(T1). The anode of D1 is connected to the common return. R3 is connected in parallel with C3. The output of the secondary voltage source 4 is coupled through a diode D3, in the anode-to-cathode direction, to the high side of the primary voltage source 2.

Operation of voltage supply 4 is contingent on the operation of the inverter circuit in the following manner. When operating the inverter develops approximately a 20 KHz square wave at the junction of Q1 and Q2. (The frequency of the output signal is largely determined by the resonant frequency of C1 and W11, the effect of W21 being substantially negligible.) The current flowing in W11 is coupled to the common return through W51, thereby developing a periodic voltage across W51 in proportion to that current. That voltage is coupled through C2 to rectifying diodes D1 and D2. In standard fashion the charge stored in C3 will represent a voltage substantially equal to the peak-to-peak voltage across W51, less losses attributable to the rectification process. Normally the voltage developed by the secondary source 4 will be less than that developed by the primary source 2 so that D3 will be reverse biased, the two sources isolated from each other, and negligible current drawn from the secondary source. However, under low-line or other aberrant conditions, the voltage at the output $V_o$ may drop so significantly that D3 will become forward biased and the secondary source will then be available to power the inverter circuitry.

Startup of the oscillator is assured by a startup circuit 5 that includes a charging resistor R4, voltage divider resistor R5 and R6, a clamping circuit, including clamping diode D4 and clamping capacitor C4, and a semiconductor switch in the form of a diac D5.

R4 is coupled from the high side of $V_o$ to one side of C3 so that, subsequent to the energization of the ballast circuit, C3 begins to charge toward the voltage at the output of that source. (To be precise, it will take some time for output of $V_o$ to attain its nominal value but this duration can be expected to be de minimis in comparison with the R4C3 time constant.) R5 and R6 are series connected across C3, so that the voltage developed at the junction of R5 and R6, ultimately coupled to D5, will track the exponentially-rising voltage across C3. As illustrated in the drawing D5 has one end coupled to the output of the voltage divider, at the junction of R5 and R6, and the other end coupled to an input of the inverter, at the base of Q2. Neglecting the effect of R3, the voltage, $V_x$, at the output of the voltage divider will increase roughly as $$R6/R5+R6\times V_o(l-e-t/R4\ C3).$$

At some time determined by the values of the components represented in that relationship above, $V_x$ will exceed the breakover voltage of D5. D5 will fire, thereby supplying bias current to the base of Q2 and initiating operation of the inverter, after which the inverter will become self-sustaining. The salient advantage of this startup circuit is that startup of the inverter is inhibited until C3 of the secondary voltage source has become charged. As a result the inverter transistors are spared some deleterious effects attendent the initial current surge required to charge C3.

The startup circuit also includes a clamping circuit comprising D4, with a cathode connected to the inverter output and an anode connected to the voltage divider output, and C4, connected from there to ground. The clamping action of D4 and C4 prevents the inverter square wave output from randomly firing D5. In effect, the clamping circuit disables the starting circuit during steady state inverter operation so that Q1 and Q2 are not subjected to transients that might result from the random firing of D5.

As illustrated in the drawing, the output of the inverter is coupled to T1 and drives a pair of fluorescent lamps, 5 and 6, having filaments 51 and 52 and 61 and 62, respectively. Filament current is supplied by secondary-wound filament windings W12, W13 and W14 on the secondary of the output transformer T1. Each of the filament windings is arranged to form a circuit loop with at least one filament of a lamp. W13 forms a loop with filament 51, W14 with filament 61, and W12 with the parallel-connected filaments 52 and 62. A bias winding, W15, on the secondary of T1 has a first end coupled to filaments 51 and 61, through a discrete ballasting inductor (L2) and oppositely poled bias windings (T3) and a second end coupled to filaments 52 and 62. The bias winding establishes the necessary voltage differential across the lamps 5 and 6 to generate ignition of both lamps.

As illustrated in the drawing the bias winding W15 is coupled to filament windings W13 and W14 through an inductance L2 and a differential transformer T3. One end of L2 is connected to the second end of W15 and the other end is connected to a common terminal of T3. T3 includes first and second oppositely-poled windings, W31 and W32. W31 and W32 each have one end coupled to the common terminal of T3 and the other ends respectively coupled to filaments 51 and 61. T3 comprises approximately 100 turns of #28 wire wound on a 3/16-inch "double-E" core, Ferroxcube type 813.

T3 operates to enhance the firing of cold lamps. Assuming that one of the lamps fires initially, there will be a sudden increase in current through either winding W21 or winding W32, depending on whether lamp 5 or lamp 6 has fired. Assuming lamp 5 has fired the current surge in winding W31 will induce a voltage in winding W32. Because W31 and W32 are oppositely poled, the voltage induced in W32 will add to the voltage developed by bias winding W15, thereby assuring that lamp 6 will fire soon after lamp 5. Of course, the opposite would be true should lamp 6 fire before lamp 5.

L2, coupled between W15 and T3, is included to provide the proper series reactance for lamp ballasting. L2 comprises approximately 75 turns, 15-#36 Litz wire wound on a Ferroxcube core as specified above.

The necessary feedback to sustain inverter oscillation is provided by interstage transformer T2. T2 includes a primary-wound feedback winding W22 and oppositely poled secondary-wound drive windings W23 and W24. As shown in the drawing W22 is part of a circuit loop that includes filament winding W12 and parallel-connected filaments 52 and 62. Therefore, the current that flows through those filaments must necessarily flow through W22 as well. This signal is fed back to W23, coupled across the base-to-emitter junction of Q1, and W24, coupled across the base-to-emitter junction of Q2, in phase opposition (by virtue of polarity of those windings) so as to effect series push-pull operation of the inverter.

As alluded to above, T2 also includes a winding W21 in series with the inverter's series resonant network, W11 and C1. W21, comprising approximately 5 to 10 turns, #36 wire, allows some relaxation of the switching parameter requirements of transistors Q1 and Q2. In particular, the switching speeds of transistor Q1 and Q2 need not be as closely matched as would be required in the absence of W21, and, therefore, less expensive transistors will be sufficient. This is because a small amount of the C1-W11 loop current is fed back to Q1 and Q2 as a function of the inverter operating frequency, thereby compensating for variations in the switching speeds of Q1 and Q2.

Dimming of the lamp is conveniently implemented by varying the inductance of primary winding W51 of T5 in any one of a number of known fashions, e.g., by varying the penetration of a magnetic core into the winding itself or otherwise (See, Ser. No. 218,311, cited above). As the inductance of W51 is increased, the negative feedback applied to the inverter is increased, (or, from another viewpoint, the power input to the inverter is decreased) and the power delivered to the lamp load will be decreased concomitantly, that is the lamp will be dimmed.

The dimming method outlined above, is, however, not without attendent drawbacks. To wit: As the inductance of W51 is increased, the net inductance seen in the inverter resonant circuit will increase and, because the frequency of oscillation of the inverter inversely varies roughly as the square root of that inductance, the net loaded impedance of the equivalent series inductance of the resonant circuit will decrease—especially the portion attributable to the primary, W11, of the output transformer. The resulting decrease in the loaded voltage across W11 will be coupled via transformer action to the secondary windings W12, W13 and W14. Because these windings directly drive the lamp filaments, the filament voltages will tend to decrease as the ballast is dimmed.

In order to compensate for the decrease in filament voltage, T5 is equipped with a secondary winding W52. W52 may be characterized by a first terminal (A) coupled to one end of W12 and a second terminal (B), adapted for coupling to filaments 52 and 62 as shown in the drawing. In an exemplary embodiment W51 comprises 75, and W52 2½, turns of wire, yielding a turns ratio of approximately 30.

W52 serves to stabilize the filament voltage in the following manner. Because the voltage across W51 tracks the voltage across C2, differing from that voltage by only the diode drop across D1, and because the (capacitive) voltage across C2 is effectively clamped regardless the dim level, the voltage across W51 and, accordingly, the voltage across W52, will remain substantially constant, independent of the dimming function. Since a component of the filament voltage, preferably a dominant component, is derived from W52, a relatively constant filament voltage will be maintained regardless the level of power supplied the lamp load.

In an extension of the concept disclosed above, a constant voltage may be supplied all the lamp filaments or a configuration comprising a plurality of lamp/ballast assemblies. What is required is that each filament have an associated winding, corresponding to W52, from which may be derived a substantially constant voltage. Furthermore, if the voltages across those windings is not required as a source of feedback to the inverter they may be used to supply the entire filament voltage rather than a mere noiety as described insofar. Finally, as a refinement, should the current flowing in a specific filament be used as the feedback signal for the oscillator, it is preferred that a portion of that filament's voltage be traced to a voltage source induced from a direct transformation of the oscillator's circulating resonant loop current, thereby assuring the desired phasing of the feedback signal and enhanced switching of the inverter devices, Q1 and Q2.

Accordingly, while there has been shown and described what at present is considered to be the preferred embodiment of a stabilized dimming circuit for an electronic ballast system, it will be obvious to those skilled in the art that various changes and modifications may be made therein without departing from the invention as defined by the appended claims.

INDUSTRIAL APPLICABILITY

This invention is useful in electronic ballast systems for fluorescent or other types of lamps.

What is claimed is:

1. In an electronic ballast system including an oscillator signal source and an output transformer for driving a lamp filament, a method of effecting stabilized lamp dimming whereby a lamp filament voltage is maintained substantially constant despite variations in the power level supplied to the lamp, the method comprising the steps of:

coupling a first inductance in the resonant loop of the oscillator signal source, substantially clamping the voltage across the first inductance, coupling a second inductance to the first inductance so that the voltage across the second inductance is in proportion to the voltage across the first inductance, and applying the voltage across the second inductance to the lamp filament so that a dominant component of the total voltage across the filament is attributable to the voltage across the second inductance.

2. A method as defined in claim 1 wherein the first inductance is a variable inductance.

3. A method as defined in claim 1 wherein the first inductance and the second inductance are magnetically coupled.

4. A method as defined in claim 3 wherein the first inductance and the second inductance are comprised by a transformer, said transformer characterized by a turns ratio approximating 30.

5. A method as defined in either claim 3 or claim 4 wherein the second inductance has a first terminal coupled to a secondary winding of the output transformer and a second terminal adapted for coupling to a lamp filament.

* * * * *